US008157159B2

(12) United States Patent
Al-Hadhoud et al.

(10) Patent No.: US 8,157,159 B2
(45) Date of Patent: Apr. 17, 2012

(54) FLIPPING TRASH CAN

(76) Inventors: Sara A-Abdulrahman Al-Hadhoud, Kuwait (KW); Reem Abdullah Al-Oufan, Kuwait (KW); Hessa Saeed Al-Ajeel, Kuwait (KW); Mona Ahmed, Kuwait (KW); Rehab Al-Naki, Kuwait (KW)

( * ) Notice: Subject to any disclaimer, the term of this patent is extended or adjusted under 35 U.S.C. 154(b) by 0 days.

(21) Appl. No.: 12/906,807

(22) Filed: Oct. 18, 2010

(65) Prior Publication Data

US 2011/0280694 A1 Nov. 17, 2011

Related U.S. Application Data

(63) Continuation-in-part of application No. 11/679,436, filed on Feb. 27, 2007, now abandoned.

(51) Int. Cl.
*A47G 29/12* (2006.01)

(52) U.S. Cl. ..... 232/43.3; 232/43.2; 232/44; 220/264; 220/908

(58) Field of Classification Search ..... 232/43.1, 232/43.2, 43.3, 44; 220/908, 908.1, 908.3, 220/262–264; 198/465.1; 312/211
See application file for complete search history.

(56) References Cited

U.S. PATENT DOCUMENTS

| | | | | | |
|---|---|---|---|---|---|
| 4,577,778 | A * | 3/1986 | Kim | 220/495.07 |
| 4,609,122 | A * | 9/1986 | Ziegenbein | 220/211 |
| 4,765,548 | A * | 8/1988 | Sing | 241/101.3 |
| 4,878,590 | A * | 11/1989 | Porter | 220/890 |
| 5,147,056 | A * | 9/1992 | Ma | 220/263 |
| 5,148,975 | A * | 9/1992 | Dickerson et al. | 232/44 |
| 5,163,574 | A * | 11/1992 | Sosan | 220/264 |
| 5,372,271 | A * | 12/1994 | Miller et al. | 220/263 |
| 5,538,338 | A * | 7/1996 | Biggers | 312/319.9 |
| 5,667,136 | A * | 9/1997 | Chen | 232/43.2 |
| 5,884,556 | A * | 3/1999 | Klepacki et al. | 100/349 |
| 6,590,146 | B1 | 7/2003 | Mrsny | |
| D518,938 | S | 4/2006 | Freitag | |
| 7,174,602 | B1 | 2/2007 | Foral | |
| 7,175,070 | B1 * | 2/2007 | Brisport et al. | 232/43.3 |
| 2006/0283929 | A1 * | 12/2006 | Lim | 232/43.2 |

* cited by examiner

*Primary Examiner* — William L. Miller
(74) *Attorney, Agent, or Firm* — Richard C. Litman

(57) ABSTRACT

The flipping trash can is adapted especially for use in fast-food restaurants or the like. The trash can includes a pedal-operated, spring-biased lid. When the lid is opened, a tray (with trash thereon) is positioned on a tray receiving mechanism that flips the tray so that trash thereon is deposited in a trash bin. The mechanism is designed to then move the empty tray to a storage area for retrieval and reuse. A sound-emitting, electronic device may be attached to the lid and is programmed to emit the phrase "Thank You" when the lid opens. The receptacle can be designed in different configurations (animals, spaceships, autos, etc) to attract attention and enhance aesthetics.

20 Claims, 3 Drawing Sheets

FLIPPING TRASH CAN

CROSS-REFERENCE TO RELATED APPLICATION

This application is a continuation-in-part of U.S. patent application Ser. No. 11/679,436 filed on Feb. 27, 2007, now abandoned, which is herein incorporated by reference in its entirety.

BACKGROUND OF THE INVENTION

1. Field of the Invention

The present invention generally relates to receptacles, and more particularly to a flipping trash can especially adapted for use in fast-food restaurants and other establishments serving food on paper plates loaded onto trays.

2. Description of the Related Art

Most fast-food restaurants rely on the customers to discard their trash. The usual practice requires customers to bring their trash-laden trays to a large trash receptacle, manually open a hinged lid on the trash receptacle, and dump the trash therein. The tray is then deposited on an adjacent shelf to be picked up and cleaned for reuse by restaurant employees. This practice sometimes requires a bit of dexterity to avoid spilling some of the trash on the floor while maintaining the lid in an open position, attempting to dump the trash, and hold on to the tray, all at the same time.

Because of these difficulties, many customers simply leave their trash-laden trays on the restaurant tables. Additional personnel must be assigned for cleanup thereby increasing operating costs and reducing efficiency. The fast-food industry would certainly welcome a user friendly, trash collecting apparatus that encourages costumer use and efficiently collects both the trash and tray. Thus, a flipping trash can solving the aforementioned problems is desired.

SUMMARY OF THE INVENTION

The flipping trash can is a trash receptacle adapted especially for use in fast food restaurants or the like. The trash receptacle includes a pedal-operated, spring-biased lid. When the lid is opened, the tray (with trash thereon) is positioned on a tray receiving mechanism that flips the tray so that trash thereon is deposited in a trash bin. The mechanism is designed to then move the empty tray to a storage area for retrieval and reuse. A sound-emitting electronic device is attached to the lid and is programmed to emit the phrase "Thank You" when the lid opens. The receptacle can be designed in different configurations (animals, spaceships, autos, etc) to attract attention and enhance aesthetics.

Accordingly, the invention presents a trash receptacle that allows easy and simple disposal of trash-laden trays in fast-food restaurants and the like. The trays are efficiently stored for retrieval and reuse. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
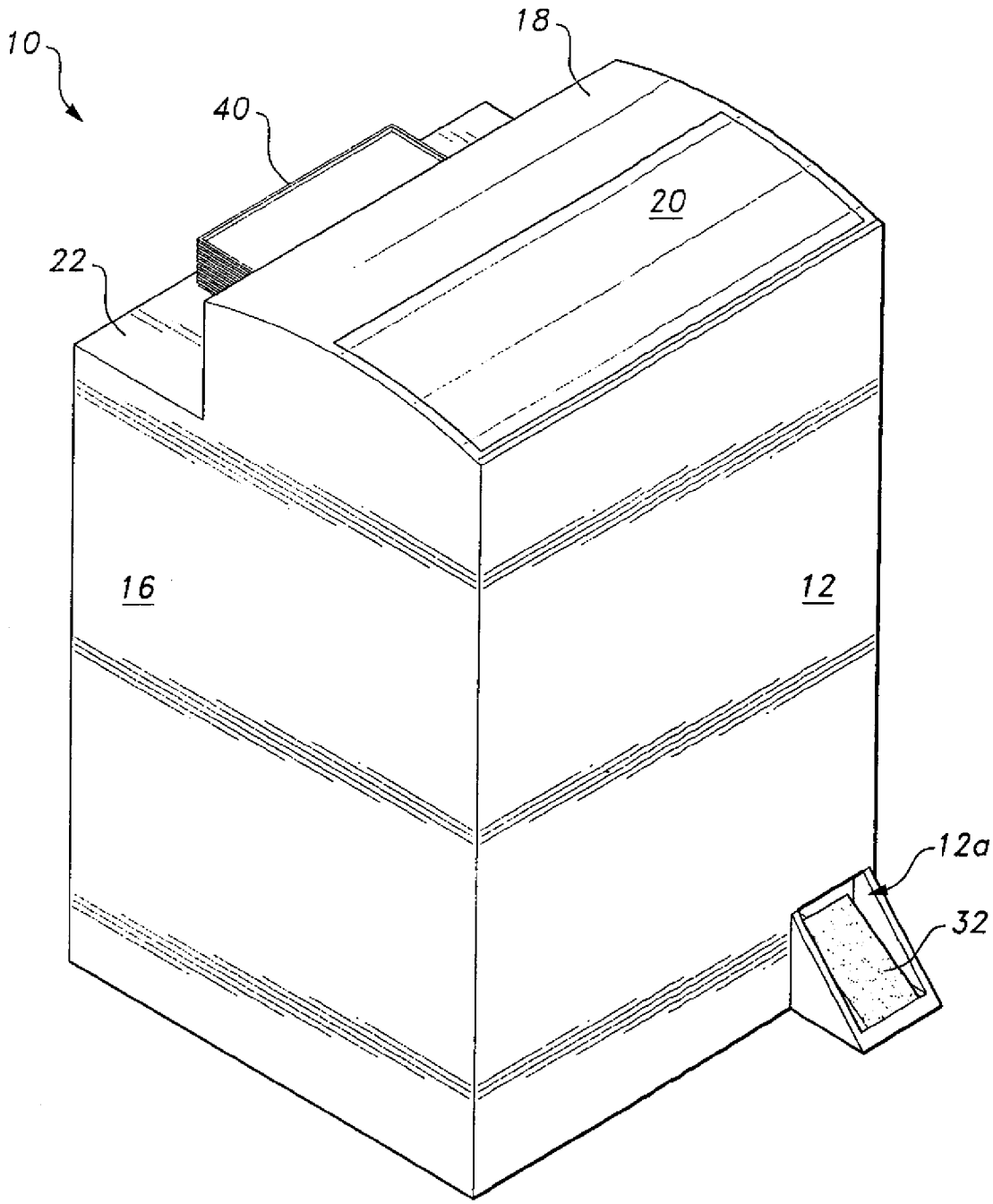
FIG. 1 is an environmental, perspective view of a flipping trash can according to the present invention.
Figure 2:
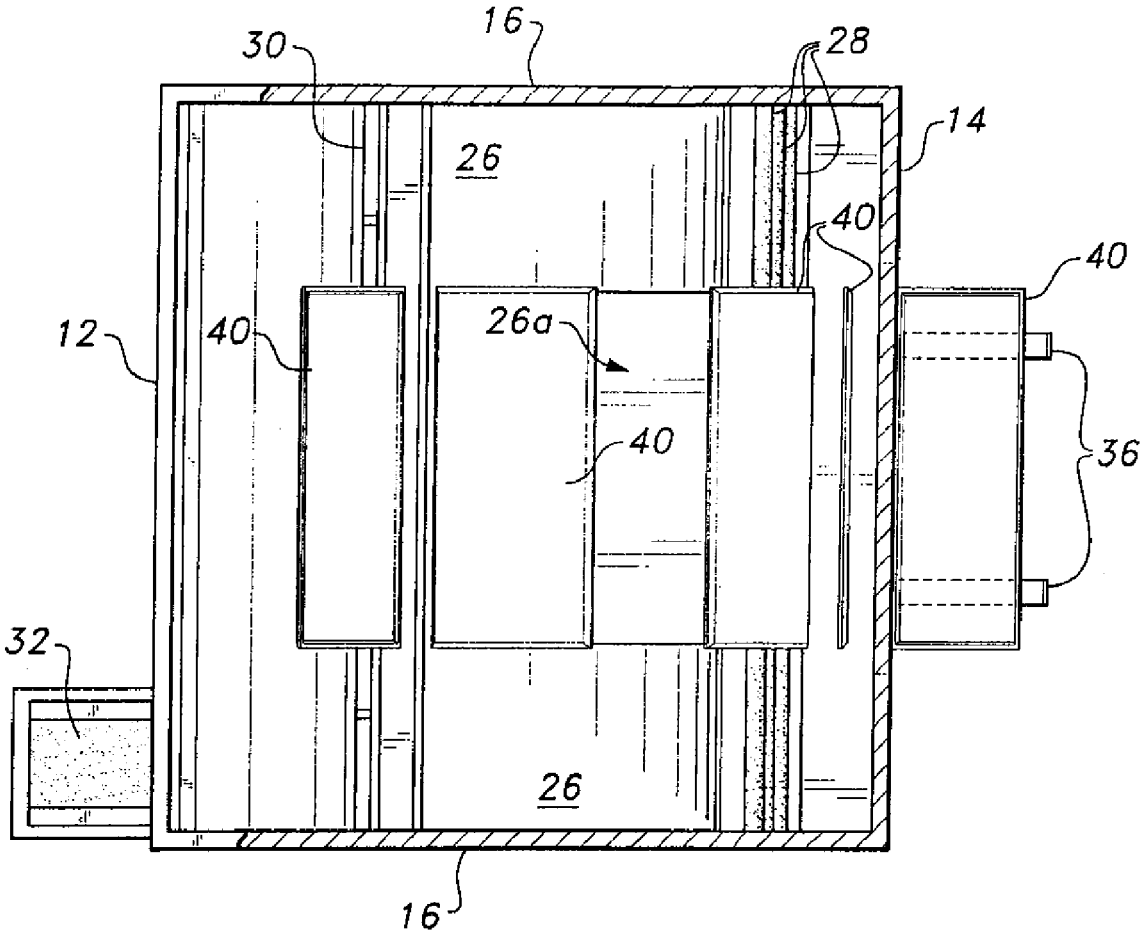
FIG. 2 is a top view of a flipping trashcan according to the present invention, shown with the housing broken away and partially in section to show details thereof.
Figure 3:
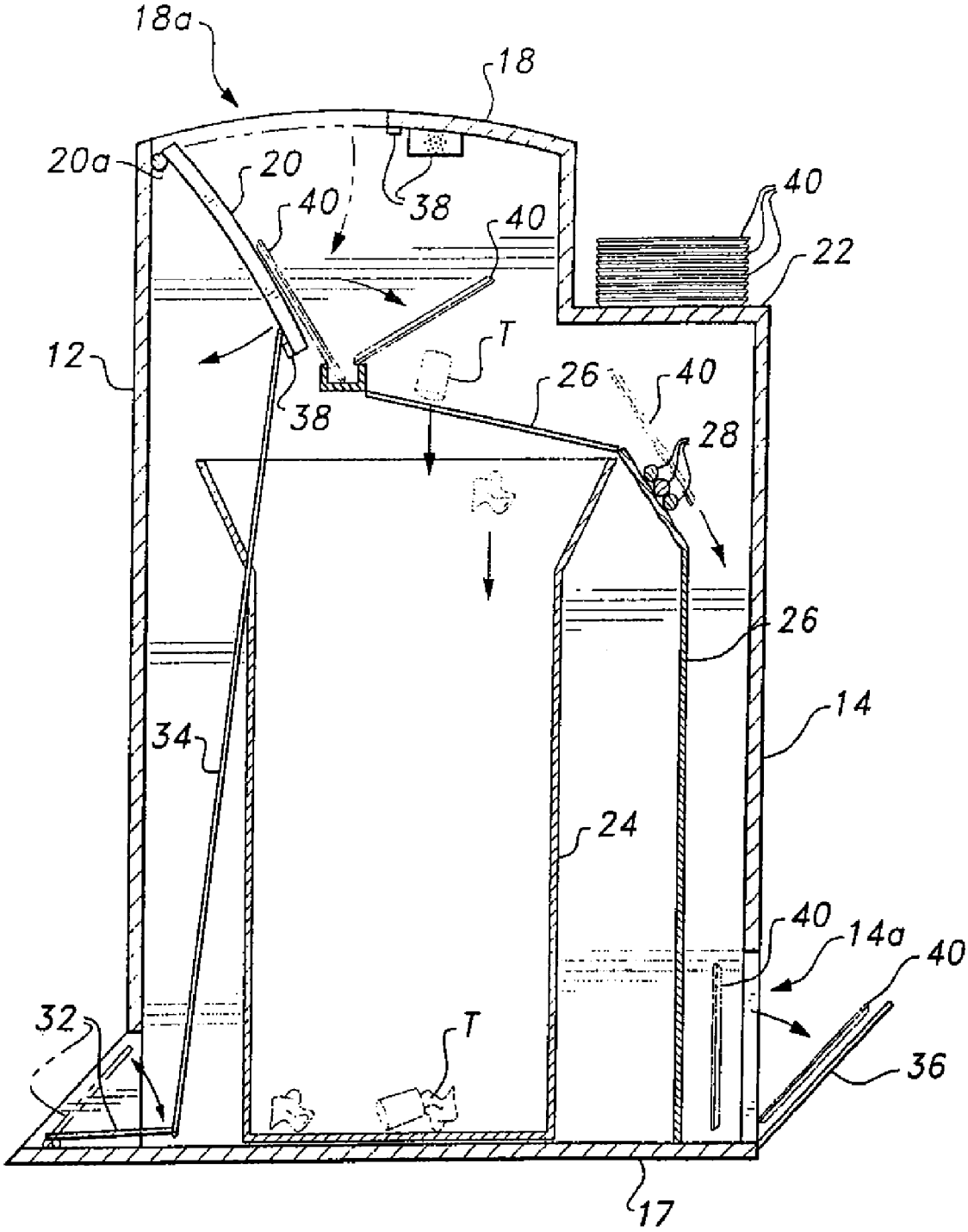
FIG. 3 is a side view in section of the flipping trash can of FIGS. 1 and 2, illustrating the tray retrieval mechanism.

Referring to FIGS. 1-3, the flipping trash can 10 comprises a housing having a front wall 12, a rear wall 14, a pair of opposing sidewalls 16, a bottom wall 17, and a top wall 18 forming a container. An opening 18*a* is formed in the top wall 18, the opening 18*a* being closed by a movable lid 20. The lid 20 has a hinge 20*a* pivotally attaching the lid 20 to the inner surface of the front wall 12, the lid 20 being pivotal downward into the housing. A shelf 22 is formed at the upper end of the rear wall 14 for purposes that will be explained below.

A removable trash container 24 (preferably a plastic bag supported on a frame) is housed within the trash can 10. A door may be provided in one of the sidewalls 16 to insert and remove the trash container 24. A slide or ramp 26 extends over the open top of the trash container 24. The slide or ramp 26 is coated with or fabricated from a material having a low coefficient of friction, and is formed with an opening 26*a* therein, whereby access to the trash container 24 is attained. The slide or ramp 26 extends angularly and downwardly to adjoin the bottom wall 17, and may be segmented to include a first segment sloping gently downward over the trash container 24, a second segment sloping more steeply rearward, and a third segment forming a wall parallel to the rear wall 14 to define a chute for the trays. A plurality of rollers 28 extends across an angular portion of slide or ramp 26, e.g., the middle segment, as shown in FIG. 3.

A U-shaped trough 30 is affixed to the top edge of the slide or ramp 26. The slide or ramp 26, the rollers 28, and the U-shaped trough 30 span the distance between the sidewalls 16. An opening 12*a* is provided at the lower end of front wall 12 closely adjacent one of the sidewalls 16. A foot pedal 32 is disposed in the opening 12*a*. A spring-biased rod 34 connects the foot pedal 32 to the movable lid 20. Another opening 14*a* is provided at the lower end of the rear wall 14 at a central area thereof. A tray return support member 36 is attached to the rear wall 14 adjacent the opening 14*a*. An electronic, battery-operated, sound-emitting device 38 is positioned on the lower surfaces of the movable lid 20 and the top wall 18.

As best seen In FIG. 3, a customer positions a tray 40 laden with trash T on the movable lid 20. The customer engages the foot pedal 32, causing the spring-biased rod 34 to open the movable lid 20 and expose the opening 18*a*. The tray 40 slides downwardly on the outer surface of the movable lid 20, and the edge of the tray 40 engages the U-shaped trough 30. Disengagement of the foot pedal 32 will allow the spring-biased rod 34 to return the lid 20 to its position closing the opening 18*a*, while causing the tray 40 to flip over and the trash T to fall through the opening 26*a* into the trash container 24. The tray 40, aided by rollers 28, continues a downward path along slide or ramp 26. The tray 40 exits the housing via the opening 14*a* and rests against the tray return support member 36. Trays 40 are retrieved from the member 36, cleaned, and deposited on the shelf 22 for further use.

When the lid 20 is drawn downward by depressing the foot pedal 32, a switch on the sound-emitting device 38 is triggered to play back a pre-recorded message, such as "Thank you." The sound-emitting device 38 may comprise, e.g., a battery powered speech synthesizer connected to a speaker, the circuit including a normally closed pushbutton or slide switch that is kept in an open position until the lid 20 is pivoted downward.

The spring-biased rod may comprise any form of spring-biased rod known in the art for raising a lowering a trash can lid by use of a foot pedal, e.g., by a compression spring or a torsion spring extending between the free end of the foot pedal 32 and the bottom wall 17, wherein the spring is compressed by depressing the foot pedal 32 as the rod 34 pulls the free end of the lid 20 downward, the spring expanding to its normal length to raise the foot pedal 32 when the user removes his foot, thereby raising the rod 34 to close the lid 20. Alternatively, the lid 20 may be spring-biased to a closed position by a torsion spring disposed between the plates of the hinge 20*a*, while the foot pedal 32 is spring-biased to a normally up position by a torsion spring.

The housing may be made from transparent material, or may be configured in ornamental shapes that might appeal to children, e.g., a teddy bear, a rabbit, etc.

It is to be understood that the present invention is not limited to the embodiments described above, but encompasses any and all embodiments within the scope of the following claims.

We claim:

1. A flipping trash can, comprising:

a housing having a front wall, a rear wall, a top wall, a bottom wall and opposing sidewalls, the top wall having an opening defined therein;

a lid pivotally attached to the top wall, the lid being pivotal between a closed position filling the opening in the top wall and an open position extending downward into the housing;

a trash container disposed inside the housing for retaining trash deposited in the housing;

a ramp positioned inside the housing, the ramp defining a path for a tray deposited in the housing, the ramp having a U-shaped channel mounted thereon positioned below the lid so that an edge of the tray slides into the channel when the lid is pivoted to the open position and so that the tray flips over to dump trash from atop the tray when the lid pivots back to the closed position; and means for pivoting the lid between the open and closed positions.

2. The flipping trash can according to claim 1, wherein said ramp has an opening therein spaced above said trash container, whereby trash dumped from the tray when the tray flips over falls into said trash container.

3. The flipping trash can according to claim 1, wherein said ramp is configured with an angled surface.

4. The flipping trash can according to claim 1, wherein said ramp is fabricated with a surface having a low coefficient of friction.

5. The flipping trash can according to claim 1, wherein said means for pivoting the lid comprises a foot pedal and a spring-biased rod extending between the foot pedal and the lid.

6. The flipping trash can according to claim 1, wherein said rear wall has an exit opening defined therein dimensioned and configured for passing the tray outside the housing.

7. The flipping trash can according to claim 6, wherein said ramp defines a chute between said trash container and said rear wall, the tray falling through the chute and out the exit opening after flipping over.

8. A trash receptacle, comprising:

a housing having a front wall, a rear wall, a top wall, a bottom wall and opposing sidewalls, the top wall having an opening defined therein;

a lid pivotally attached to the top wall, the lid being pivotal between a closed position filling the opening in the top wall and an open position extending downward into the housing;

a trash container removably disposed inside the housing for retaining trash deposited in the housing;

a ramp positioned inside the housing, the ramp defining a path for a tray deposited in the housing, the ramp having an opening defined therein disposed over the trash container, the ramp having a U-shaped channel mounted thereon positioned below the lid so that an edge of the tray slides into the channel when the lid is pivoted to the open position and so that the tray flips over to dump trash from atop the tray through the opening into the trash container when the lid pivots back to the closed position; and means for pivoting the lid between the open and closed positions.

9. The trash receptacle according to claim 8, wherein said ramp is configured with an angled surface.

10. The trash receptacle according to claim 8, wherein said ramp is fabricated with a surface having a low coefficient of friction.

11. The trash receptacle according to claim 8, wherein said means for pivoting the lid comprises a foot pedal and a spring-biased rod extending between the foot pedal and the lid.

12. The trash receptacle according to claim 8, wherein said rear wall has an exit opening defined therein dimensioned and configured for passing the tray outside the housing.

13. The trash receptacle according to claim 12, wherein said ramp defines a chute between said trash container and said rear wall, the tray falling through the chute and out the exit opening after flipping over.

14. The trash receptacle according to claim 13, further comprising a tray retainer disposed outside the rear wall adjacent the exit opening, whereby trays passing through the exit opening collect on the tray retainer.

15. A trash receptacle, comprising:

a housing having a front wall, a rear wall, a top wall, a bottom wall and opposing sidewalls, the top wall having an opening defined therein;

a lid pivotally attached to the top wall, the lid being pivotal between a closed position filling the opening in the top wall and an open position extending downward into the housing;

a trash container removably disposed inside the housing for retaining trash deposited in the housing;

a ramp positioned inside the housing, the ramp defining a path for a tray deposited in the housing, the ramp having an opening defined therein disposed over the trash container, the ramp having a U-shaped channel mounted thereon positioned below the lid so that an edge of the tray slides into the channel when the lid is pivoted to the open position and so that the tray flips over to dump trash from atop the tray through the opening into the trash container when the lid pivots back to the closed position; and a foot pedal and a spring-biased rod extending between the foot pedal and the lid for pivoting the lid between the open and closed positions.

16. The trash receptacle according to claim 15, further including a plurality of rollers positioned on said ramp.

17. The trash receptacle according to claim 15, wherein said ramp is fabricated with a surface having a low coefficient of friction.

18. The trash receptacle according to claim 15, wherein said rear wall has an exit opening defined therein dimensioned and configured for passing the tray outside the housing.

19. The trash receptacle according to claim 18, wherein said ramp defines a chute between said trash container and said rear wall, the tray falling through the chute and out the exit opening after flipping over.

20. The trash receptacle according to claim 19, further comprising a tray retainer disposed outside the rear wall adjacent the exit opening, whereby trays passing through the exit opening collect on the tray retainer.

* * * * *